US010487611B2

(12) United States Patent
Shampine

(10) Patent No.: US 10,487,611 B2
(45) Date of Patent: Nov. 26, 2019

(54) DEPLOYMENT METHOD FOR COILED TUBING

(71) Applicant: SCHLUMBERGER TECHNOLOGY CORPORATION, Sugar Land, TX (US)

(72) Inventor: Rod William Shampine, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/550,633

(22) PCT Filed: Feb. 10, 2016

(86) PCT No.: PCT/US2016/017243
§ 371 (c)(1),
(2) Date: Aug. 11, 2017

(87) PCT Pub. No.: WO2016/130612
PCT Pub. Date: Aug. 18, 2016

(65) Prior Publication Data

US 2018/0038188 A1 Feb. 8, 2018

Related U.S. Application Data

(60) Provisional application No. 62/115,791, filed on Feb. 13, 2015.

(51) Int. Cl.
*E21B 33/068* (2006.01)
*E21B 33/076* (2006.01)

(52) U.S. Cl.
CPC ..... *E21B 33/068* (2013.01); *E21B 33/076* (2013.01)

(58) Field of Classification Search
CPC ..... E21B 33/068; E21B 33/076
See application file for complete search history.

(56) References Cited

U.S. PATENT DOCUMENTS 4,325,434 A 4/1982 Roberts
4,940,095 A 7/1990 Newman
(Continued)

FOREIGN PATENT DOCUMENTS

WO 2001020129 A2 3/2001
WO 2010064920 A1 6/2010
(Continued)

OTHER PUBLICATIONS

International Search Report and Written Opinion issued in International Patent Appl. No. PCT/US2016/017243 dated May 17, 2016; 11 pages.
(Continued)

*Primary Examiner* — Nicole Coy

(57) ABSTRACT

Methods include providing a first portion of a tool string including a tool, a deployment bar, and at least one deployment valve, where the deployment valve includes a valve therein which is operable under wellbore pressure and further comprises a fluid passageway there through. The first portion of the tool string is connected to a conveyance device in a riser, and then moved into a blowout preventer body having at least one sealing ram for engaging with a neck on the deployment bar, where the valve is in an open position and the riser is under wellbore pressure during the moving. The at least one sealing ram is closed on the neck, valve closed, and pressure reduced in the riser. In some cases, the valve is pressure tested before pressure is reduced in the riser.

27 Claims, 6 Drawing Sheets

(56) References Cited

U.S. PATENT DOCUMENTS

| | | | |
|---|---|---|---|
| 6,050,338 | A | 4/2000 | Watkins |
| 6,164,619 | A | 12/2000 | Van Winkle et al. |
| 6,192,983 | B1 | 2/2001 | Neuroth et al. |
| 6,209,652 | B1 | 4/2001 | Portman et al. |
| 6,913,084 | B2 | 7/2005 | Boyd |
| 7,814,972 | B2 | 10/2010 | Angman et al. |
| 8,047,295 | B2 | 11/2011 | Skeels et al. |
| 8,146,660 | B2 | 4/2012 | Irani et al. |
| 9,080,412 | B2 | 7/2015 | Wetzel et al. |
| 2004/0104024 | A1 | 6/2004 | Kent et al. |
| 2007/0051512 | A1 | 3/2007 | Markel et al. |
| 2007/0137866 | A1 | 6/2007 | Ravensbergen et al. |
| 2007/0162235 | A1 | 7/2007 | Zhan et al. |
| 2009/0084558 | A1 | 4/2009 | Bloom |
| 2009/0260804 | A1 | 10/2009 | Mydur et al. |
| 2010/0104372 | A1 | 4/2010 | Lawson et al. |
| 2010/0155054 | A1 | 6/2010 | Innes et al. |
| 2010/0163243 | A1 | 7/2010 | Sbordone |
| 2010/0230112 | A1 | 9/2010 | Cox et al. |
| 2011/0267922 | A1 | 11/2011 | Shampine et al. |
| 2011/0272148 | A1 | 11/2011 | Lovell et al. |
| 2012/0125622 | A1 | 5/2012 | Melancon et al. |
| 2013/0341539 | A1 | 12/2013 | Hughes et al. |
| 2014/0048256 | A1 | 2/2014 | Ringgenberg |
| 2014/0166270 | A1 | 6/2014 | Varkey et al. |
| 2014/0231075 | A1 | 8/2014 | Springett et al. |
| 2016/0215584 | A1 | 7/2016 | Tennant |

FOREIGN PATENT DOCUMENTS

| | | | |
|---|---|---|---|
| WO | 2014074099 | A1 | 5/2014 |
| WO | 2016130617 | A1 | 8/2016 |
| WO | 2016130619 | A1 | 8/2016 |
| WO | 2016130620 | A1 | 8/2016 |

OTHER PUBLICATIONS

International Search Report and Written Opinion issued in International Patent Appl. No. PCT/US2016/017259 dated Apr. 25, 2016; 25 pages.

International Search Report and Written Opinion issued in International Patent Appl. No. PCT/US2016/017256 dated May 3, 2016; 17 pages.

International Search Report and Written Opinion issued in International Patent Appl. No. PCT/US2016/017254 dated May 3, 2016; 14 pages.

International Search Report and Written Opinion issued in International Patent Appl. No. PCT/US2016/017250 dated May 11, 2016; 10 pages.

140
102
142
106
124
302
122
310
306

102
142

140
118
102
104
312

404
402
312

142
124
114
406
406
102
122
306

404
114
406
406

DEPLOYMENT METHOD FOR COILED TUBING

RELATED APPLICATION INFORMATION

This Patent Document claims priority under 35 U.S.C. § 120 to U.S. Provisional Patent Application No. 62/115,791 filed Feb. 13, 2015, which is incorporated herein in its entirety.

FIELD

The present disclosure is related in general to wellsite equipment such as oilfield surface equipment, downhole assemblies, coiled tubing (CT) assemblies, slickline and assemblies, and the like.

BACKGROUND

Coiled tubing is a technology that has been expanding its range of application since its introduction to the oil industry in the 1960's. Its ability to pass through completion tubulars and the wide array of tools and technologies that can be used in conjunction with it make it a very versatile technology.

Typical coiled tubing apparatus includes surface pumping facilities, a coiled tubing string mounted on a reel, a method to convey the coiled tubing into and out of the wellbore, such as an injector head or the like, and surface control apparatus at the wellhead. Coiled tubing has been utilized for performing well treatment and/or well intervention operations in existing wellbores such as, but not limited to, hydraulic fracturing, matrix acidizing, milling, perforating, coiled tubing drilling, and the like.

In the oilfield, the length of downhole tools is often dependent on what function they are to perform, where additional functions typically require additional length. As more and more sophisticated functions are performed down hole, these tools have grown in length to the point where installing them in the well bore has become a significant challenge in the face of maintaining well control while this is performed. The process of placing tools into the well bore is referred to as deployment.

In spooled conveyance services such as coiled tubing, wireline, and slickline, downhole tools need to be transferred from the reel to inside the well bore. This transfer may be accomplished using a long riser with the conveyance attached to the top of the long riser. In this method, the tools are either pulled into the bottom of this riser, or are assembled into it. The riser is then attached to the well, is pressure tested, then the tools are run into the well after a successful test. In some cases, an 'easier to run' service is utilized to place the tools in the well, followed by a 'harder to run' service to perform the running in hole. In such cases, the downhole tools are provided with an additional part known as a deployment bar. This deployment bar is intended to provide a surface against which the blowout preventers (BOPs) can both grip and seal. In the case where the 'harder to run' service is coiled tubing, wireline or slickline may be used to pre-place the tools in the coiled tubing BOP. The deployment bar used will be selected to have a diameter substantially equal to the coiled tubing diameter. As part of the contingency plans, it is possible to close the master valves of the BOP. In order to do this while the downhole tools are hanging in the BOPs, and without opening the well to atmosphere (thereby creating a blowout), the deployment bar is capable of being sheared by the shear ram in the BOP.

Once this is done, the slip and pipe rams can be opened and the tool dropped into the well.

Present positioning systems have limitations in positioning accuracy, particularly after having made large moves (like in and out of a well). In order to accommodate this, deployment bars are commonly made twice as long as the actual length required to clear all the pipe rams. Pulling the conveyance means up against its upper sealing means (stripper or packer) is used to re-locate, reducing the positioning issues. However, tagging parts implies a significant risk of pulling the conveyance means out of its attachment point. Further, positioning the deployment bar section accurately can range from difficult to extremely difficult, as it is very difficult to make precise moves with coiled tubing.

It remains desirable to provide improvements in oilfield surface equipment and/or downhole assemblies such as, but not limited to, methods and/or systems for deploying coiled tubing into wellbores.

SUMMARY

This section provides a general summary of the disclosure, and is not a necessarily a comprehensive disclosure of its full scope or all of its features.

In a first aspect of the disclosure, methods include providing a first portion of a tool string including a tool, a deployment bar, and at least one deployment valve, where the deployment valve includes a valve therein which is operable under wellbore pressure and further comprises a fluid passageway there through. The first portion of the tool string is connected to a conveyance device in a riser, and then moved into a blowout preventer body having at least one sealing ram for engaging with a neck on the deployment bar, where the valve is in an open position and the riser is under wellbore pressure during the moving. The at least one sealing ram is closed on the neck, valve closed, and pressure reduced in the riser. In some cases, the valve is pressure tested before pressure is reduced in the riser. The blowout preventer body may be fluidly connected with a hydraulic control valve for sensing a differential pressure across the at least one sealing ram, and the hydraulic control valve may operate as a hydraulic interlock to prevent the at least one sealing ram from being moved to the ram open position under predetermined differential pressure conditions. The at least one sealing ram may be contained within a cylinder formed in the blowout preventer body, and each of the at least one sealing rams connected with a ram piston sealingly disposed in the cylinder.

In some aspects, the conveyance device is disconnected from the first portion of a tool string, and a second portion of a tool string is provided which includes a second tool, a second deployment bar, and a second deployment valve, where the second deployment valve comprises a valve therein which is operable under wellbore pressure and further includes a fluid passageway there through. The second portion of a tool string is then connected to the conveyance device and to the first portion of a tool string in the riser, the riser pressurized, and the at least one sealing ram is released from the neck of the first deployment bar. The connecting the second portion of a tool string to the conveyance device and to the first portion of a tool string may be conducted through a window in the riser. The second portion of a tool string may then be moved into the blowout preventer body and the first portion of a tool string moved into a wellbore, while the valves in the first and second portions are in an open position in fluid communication, and the riser under wellbore pressure during the moving.

In some cases, the at least one sealing ram is closed on the neck of the second deployment bar, pressure reduced in the riser and the valves in the first and second portions closed, and the second portion of a tool string is disconnected from the conveyance device. The second portion of a tool string may then be connected to a coiled tubing conveyance device in the riser, the at least one sealing ram released from the neck of the second deployment bar, and the first and second portions of a tool string are moved into the wellbore to conduct at least one wellbore operation.

The conveyance device may in some aspects be a coiled tubing which includes at least one check valve and one or more additional valves which maintain pressure in two directions. The check valve(s) may provides an initial sealing means to allow reduction of pressure in the riser, and then one or more additional valves may be engaged and tested.

In some embodiments, the fluid passageway in the deployment valve includes a first fluid passageway and a second fluid passageway, and the first fluid passageway and the second fluid passageway are in fluid communication with a coiled tubing when the valve is in an open position. The fluid communication between the first fluid passageway and the second fluid passageway may be interrupted when the valve is in a closed position.

Some other embodiments are methods of deploying a coiled tubing tool string into a wellbore which include connecting a first portion of a tool string to a conveyance device in a riser, where the first portion of a tool string contains a deployment valve operable under wellbore pressure, and moving the first portion of a tool string into a blowout preventer body having at least one sealing ram for engaging with the first portion of a tool string, where the deployment valve is in an open position and the riser is under wellbore pressure during the moving. The at least one sealing ram may then close on the first portion of a tool string, reducing pressure in the riser reduced, and the deployment valve allowed to close. The conveyance device may be disconnected from the first portion of a tool string, and a second portion of a tool string connected to the conveyance device in the riser, where the second portion of a tool string comprises a deployment valve operable under wellbore. The at least one sealing ram may be released from the first portion of a tool string, and the second portion of a tool string moved into the blowout preventer body while the first portion of a tool string is moved into the wellbore. While being moved, the deployment valves in the first and second portions are in an open position in fluid communication, and the riser is under wellbore pressure. The methods may further include closing the at least one sealing ram on the second portion of a tool string, reducing pressure in the riser and allowing the deployment valves in the first and second portions to close, and disconnecting the second portion of a tool string from the conveyance device. The second portion of a tool string may then be connected to a coiled tubing conveyance device in the riser, the at least one sealing ram released from the second portion of a tool string, and the first and second portions of a tool string deployed into the wellbore to conduct at least one wellbore operation.

Other method embodiments include deploying a coiled tubing tool string into a wellbore by providing a system comprising a wellhead disposed on a wellbore casing, a blowout preventer body disposed on the wellhead, and a riser disposed on the blowout preventer body, where the blowout preventer body comprises at least one sealing ram for engaging with the first portion of a tool string. The first portion of a tool string is connected to a conveyance device in the riser, and the first portion of a tool string includes a deployment valve operable under wellbore pressure. The first portion of a tool string is moved into the blowout preventer body, wherein the deployment valve is in an open position and the riser is under wellbore pressure during the moving. The at least one sealing ram is closed on the first portion of a tool string, and pressure reduced in the riser. The conveyance device is then disconnected from the first portion of a tool string, and a second portion of a tool string connected to the conveyance device in the riser, where the second portion of a tool string comprises a deployment valve operable under wellbore pressure. The at least one sealing ram is released from the first portion of a tool string, the second portion of a tool string moved into the blowout preventer body while the first portion of a tool string is moved into the wellbore, and the riser is under wellbore pressure during the moving. The methods may further include closing the at least one sealing ram on the second portion of a tool string, and reducing pressure in the riser. Then disconnecting the second portion of a tool string from the conveyance device, connecting the second portion of a tool string to a coiled tubing conveyance device in the riser, releasing the at least one sealing ram from the second portion of a tool string, and deploying the first and second portions of a tool string into the wellbore to conduct at least one wellbore operation.

Another method embodiment includes providing a first portion of a tool string having a tool, a deployment bar, and at least two deployment valves, where each of the deployment valves contains a valve therein which is operable under wellbore pressure, a fluid passageway there through, and at least two sealing means. The first portion of a tool string is connected to a conveyance device in a riser, and then the first portion of a tool string moved into a blowout preventer body having at least one sealing ram for engaging with a neck on the deployment bar, and the valve is in an open position and the riser is under wellbore pressure during the moving. The at least one sealing ram is closed on the neck, one or more of the valves are closed, and pressure reduced in the riser. The method may further include disconnecting the conveyance device from the first portion of a tool string, providing a second portion of a tool string having a second tool, a second deployment bar, and a second deployment valve, where the second deployment valve comprises a valve therein which is operable under wellbore pressure and further comprises a fluid passageway there through. The second portion of a tool string may then be connected to the conveyance device and to the first portion of a tool string in the riser, and pressure increased in the riser to wellbore pressure. The at least one sealing ram may then be released from the neck of the first deployment bar, and the second portion of a tool string moved into the blowout preventer body while the first portion of a tool string moves into a wellbore, with the valves in the first and second portions in an open position and in fluid communication. In some cases, the at least two sealing means are pressure tested before and/or opening the riser.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1A:
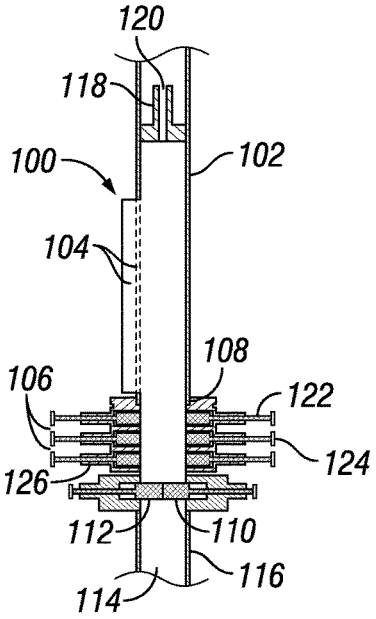
FIG. 1 illustrates an embodiment of a blow out preventer in an open position, in accordance with the disclosure.

The following description of the variations is merely illustrative in nature and is in no way intended to limit the scope of the disclosure, its application, or uses. The description and examples are presented herein solely for the purpose of illustrating the various embodiments and should not be construed as a limitation to the scope and applicability of such. Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present). In addition, use of the "a" or "an" are employed to describe elements and components of the embodiments herein. This is done merely for convenience and to give a general sense of concepts according to the disclosure. This description should be read to include one or at least one and the singular also includes the plural unless otherwise stated. The terminology and phraseology used herein is for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited. Also, as used herein any references to "one embodiment" or "an embodiment" means that a particular element, feature, structure, or characteristic described in connection with the embodiment is included in at least one embodiment. The appearances of the phrase "in one embodiment" in various places in the specification are not necessarily referring to the same embodiment.

Embodiments according to the disclosure provide methods and/or systems for safely and efficiently deploying long coiled tubing tools having one or more sections or portions, into a wellbore that is under pressure. In some aspects, a specific set of blow out preventer (BOP) rams, ancillary pressure control hardware, system for accurately moving the tools under pressure with an external indication means, and/or a method for controlling the flow through tool passages during deployment, are used. Some deployment embodiments of the disclosure involve providing and moving the tool, locating the tool, sealing on the tool, and sealing the flow passage(s) disposed through the tool.

Some embodiments of coiled tubing deployment methods according to the present disclosure may include a tool locating means directly sensing the tool location inside the deployment system, and the tool string may also include one or more valves in the tool string that are configured to close off ports in the tool string in response to an action of the deployment stack. The method may utilize a tool coupling means that may be connected and disconnected without rotating the tool string or the conveyance means. The method may also utilize testable sealing means in the deployment stack whereby each seal that is opened may be separately tested upon re-closure to verify its integrity.

In some aspects, embodiments of a coiled tubing deployment method according to the present disclosure may include moving a tool string through a pressure barrier in two or more sections or portions. The movement of the tool string is enabled by a deployment conveyance device, two or more annular sealing members or methods, one or more tool passage sealing members or methods, and a well conveyance, where the activation of the tool passage sealing members or methods activation is controlled and/or permitted by an action(s) of the deployment pressure barrier elements and/or sealing means. The deployment conveyance arrangement may also include a deployment bar defining fluid passage(s) therein and the well conveyance device may include a coiled tubing string, or other suitable conveyance means.

Referring now to FIGS. 1A through 1F, which illustrates in general aspects, some embodiments according to the disclosure in cross sectional view. The embodiments are methods, which include some or all of the following described processes, and while one order of processes is described, it is within the scope and spirit of the disclosure that any suitable order of processes be used. In accordance with the method, each time a pressure barrier (such as a riser connection, window opening, deployment valve, or blow out preventer ram) is closed, the system may be tested for both pressure integrity, and as required, mechanical integrity (such as by a pull test).

In FIG. 1A some pressure control equipment used for the deployment and conveyance of the coiled tubing tool(s) into the wellbore includes pressure barrier equipment such as a riser 102 containing an operable window opening 104, a deployment valve attached to the tool (see FIG. 1B), a blow out preventer 106 with rams, and/or a riser connection 108 for sealingly connecting the riser 102 with, the blow out preventer 106. Blow out preventer 106 is securely attached to wellhead 110 having master valve 112 disposed therein, and wellhead 110 is mounted over wellbore 114 to a casing 116, which defines a wellbore 114 therein. An upper end of riser 102 includes a lubricating/sealing device 118 for providing sufficient sealing yet allowing conveyance equipment, such as coiled tubing, microtubing, wireline, slickline or other cable, to pass through opening 120, while riser 102 is under wellbore pressure. Blow out preventer 106 includes pipe or pipe/slip rams 122 and 124 (four shown) for sealing on a deployment neck disposed in a tool string, and further includes shearing rams 126 (two shown) for cutting the tool string, and sealing off the wellbore pressure from the atmosphere. Some non-limiting examples of suitable blow out preventers are those disclosed in U.S. Provisional Pat. App. Ser. No. 62/115,731, titled 'Blowout Preventer with Interlock', filed Feb. 13, 2015, as well as any related continuity patent applications, each of which is incorporated herein in their entirety by reference thereto. Described as a whole, the arrangement of pressure control equipment is referred to as 100. In FIG. 1A, master valve is shown in a closed position thus sealing off wellbore pressure from the atmosphere during the rig up of pressure control equipment 100.

In some aspects, the deployment blow out preventer 106 is provided with not less than two means to seal on a deployment neck and an additional sealing means that engages such deployment neck and allows both of the primary sealing means to be pressure tested from the wellbore side of blow out preventer 106. In another aspect, other non-blow out preventer ram seals may be used which provide the ability of the system to be separately tested in the operating pressure direction without the need to pressure test the entire pressure envelope. Such seals are commonly used on specialized quick test subs, but are not used on other connections, such as the sealing means of a work window.

Figure 1B:
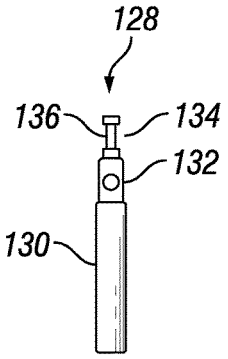

Now referring to FIG. 1B, depicting in cross-sectional view, a portion of a tool string deployed in the processes. Provided are coiled tubing tool 130, deployment valve 132, and deployment bar 134 including deployment neck 136. Described as a whole, this portion of a tool string is referred to as 128. Coiled tubing tool 130 may be any tool used in a wellbore or subterranean formation treatment operation conducted with coiled tubing tools, including, but not limited to, hydraulic fracturing, matrix acidizing, milling, perforating, coiled tubing drilling, cleanout, intervention, and the like.

Deployment valve 132 may be any suitable valve system for selectively shutting off, or otherwise isolating, fluid flow through one or more passages through the tool string. Such passages may be used to pump fluid down into the wellbore, into the subterranean formation, or both, to perform an operation, and/or may transfer fluid flow upward. Suitable deployment valves are both selectively opened and closed under pressure, while disposed within pressure control equipment 100. In some aspects, suitable deployment valves are those that may be tested from the top to verify its function. In some other aspects, suitable deployment valves are those, which may be tested from the bottom. Some non-limiting examples of suitable deployment valves are those disclosed in U.S. Provisional Pat. App. Ser. No. 62/115,773, titled 'Deployment Valves Operable Under Pressure', filed Feb. 13, 2015, as well as related continuity patent applications, the disclosures of each of which are incorporated herein in their entirety by reference thereto.

Deployment bar 134, which includes deployment neck 136, may be any suitable deployment bar design or arrangement useful in the embodiments of the disclosure. Further, when a connection is made, for example with coiled tubing, wireline, slickline, micro-tubing, and the like, on one end of the deployment bar, the deployment neck is capable of being held in the deployment blow out preventer 106 for pull test purposes. Some non-limiting examples of suitable deployment bars are those disclosed in U.S. Provisional Pat. App. Ser. No. 62/115,750, titled 'Shearable Deployment Bars with Multiple Passages & Cables', filed Feb. 13, 2015, as well as related continuity patent applications, each of which is incorporated herein in their entirety by reference thereto. As part of contingency plans, the deployment neck 136 is designed such that the deployment blow out preventer shearing ram(s) 126 can shear it. The same ram(s) 126 may be capable of cutting a coiled tool string at most or all points along the tool string, as well as the capability to seal on the tool string.

Figure 1C:
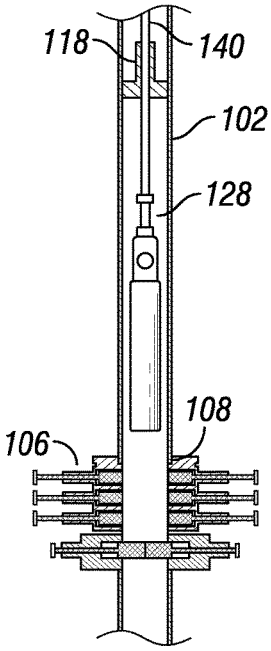
Figure 1D:
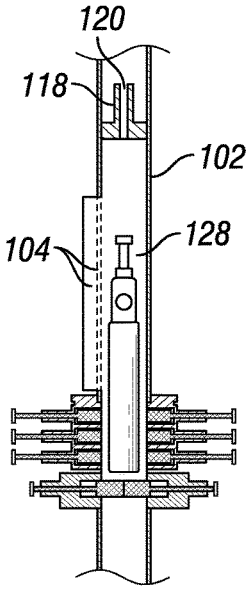
Figure 1E:
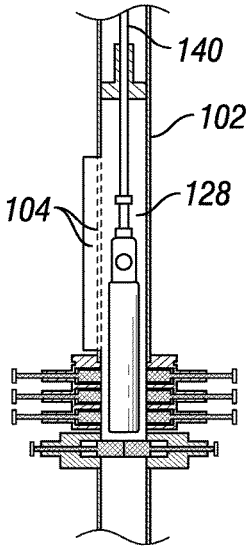

As illustrated in FIG. 1C, in some cases, the portion of a tool string 128 may be assembled, and then placed in riser 102. A connection may then be made with conveyance device 140, and the riser 102 containing the portion of a tool string 128 set down onto deployment blow out preventer 106, and sealingly secured therewith by riser connection 108. Alternatively, as depicted in FIGS. 1D and 1E, portion of a tool string 128 may be assembled within riser 102 (FIG. 1D) through window opening 104 in those instances where riser 102 is previously sealingly secured to deployment blow out preventer 106 by riser connection 108. In FIG. 1E, after assembling portion of a tool string 128, conveyance device may be passed through opening 120 of lubricating/sealing device 118 and connected with tool string portion 128.

Figure 1F:
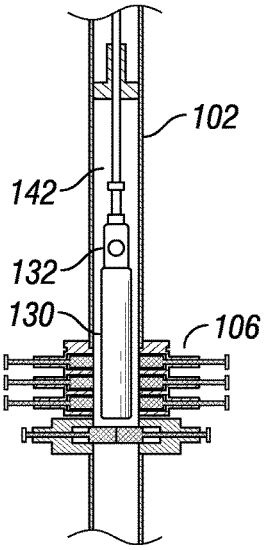

Now referring to FIG. 1F, window opening 104 of riser 102 is closed to provided a pressure barrier from the atmosphere as the space within riser 102 is increased to pressure 142 substantially equal to wellbore pressure. A valve or valves contained within deployment valve 132 is also closed to isolate higher fluid pressure from below from above the valve. Pressure containment within riser 102 is then verified, and a lower end of tool 130 (which is connected on an opposing end with conveyance device 140) is disposed adjacent and within blow out preventer 106.

Figure 2D:
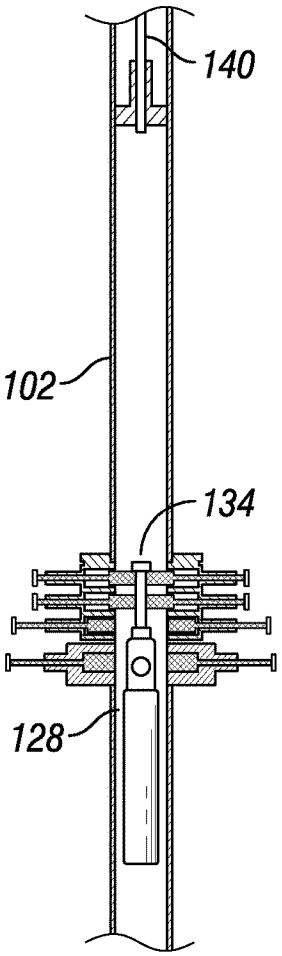
FIG. 2 shows an embodiment of a blow out preventer in a closed position, according to the disclosure.
Figure 2C:
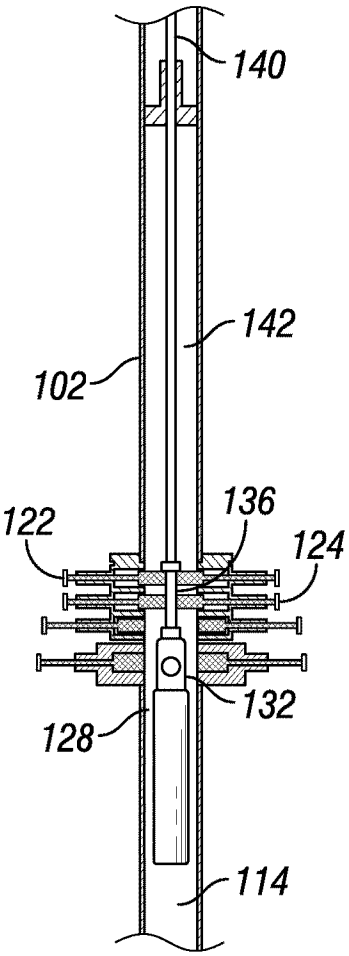
Figure 2B:
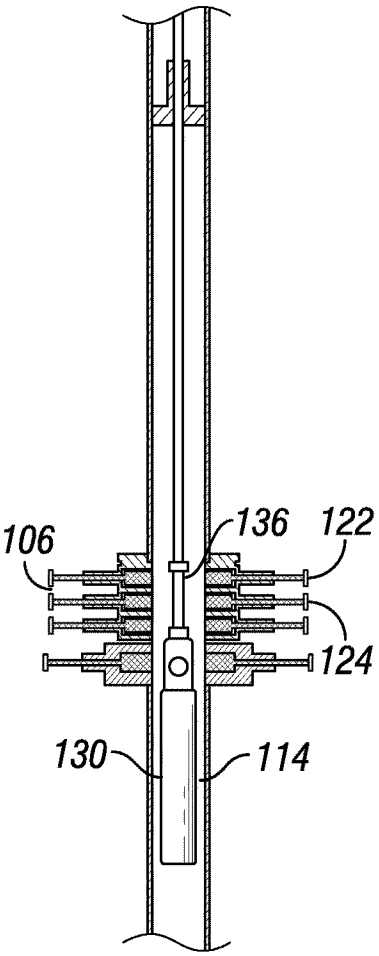
Figure 2A:
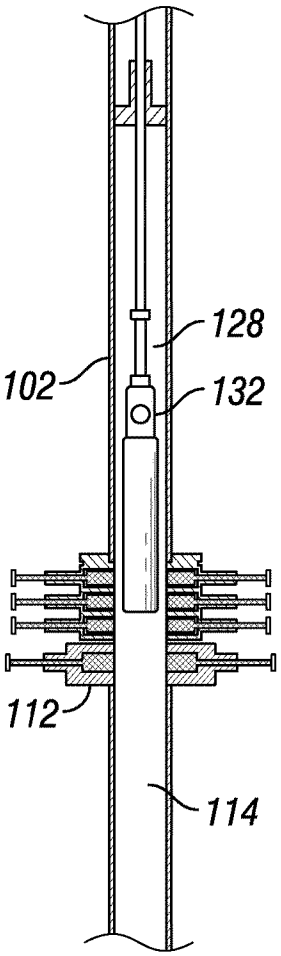

FIGS. 2A through 2D show deployment of a portion of tool string 128 into wellbore 114. With pressure containment within riser 102 verified, wellhead master valve 112 is then open, as depicted, which may equalize pressure between along wellbore 114 and within riser 102. The valve or valves contained within deployment valve 132 may also be opened. Tool 130 is then moved into wellbore 114 to a target location with deployment neck 136 positioned adjacent and within deployment blow out preventer 106 at a target location, as shown in FIG. 2B. A suitable locating device and/or technique, may be used to detect and/or fix the position of the deployment neck 136 within deployment blow out preventer 106. In some cases, the locating device can bear the tool string load, and thus should be tested by verifying that the tool string load is reduced after engagement. Also, use of such locating device and/or technique also allows neck 136, when engaged by the deployment blow out preventer rams 122 and 124, to be sized only enough to enable actual engagement, and in some cases, some additional nominal length, which is less than the length required for engagement.

Some non-limiting examples of locating devices and/or techniques include a tool trap engaging a shoulder on the tool and providing both precise location and load bearing capability at that location, a moving pin or roller disposed within the system that follows the outer diameter of the tool and can bear enough weight to allow easy detection of this load with the conveyance means, an external indicator accurately coupled to the deployment device and moving with it, or a detection system acting through the pressure barrier to provide precise location of the tool. Some examples of detection systems acting through the pressure barrier include magnetic fields produced by the tool and either passive or active detection of same, radioactive source in the tool and an external detection means, X-ray or gamma radiation passing through the tool and pressure barrier with an external detection means to locate the deployment neck and/or a high neutron cross section tagged area on the tool, ultrasound waves reflected off of the tool to locate the change in range as the deployment neck passes, change in magnetic reluctance as the tool cross section inside of a pressure-containing sensor system changes, ultrasound radiated from the tool and used to detect the range between the tool source and the detection means on the pressure barrier, probe passing through the pressure barrier used to physically sense the tool profile, and the like.

With reference again to FIGS. 2A through 2D, once coiled tubing tool 130, deployment valve 132 and deployment bar 134 are appropriately positioned as shown in FIG. 2B, pipe or pipe/slip rams 122 and 124 are closed on deployment neck 136 to secure portion of tool string 128 and isolate pressure from the space within riser 102, as depicted in FIG. 2C. The valve contained within deployment valve 132 is also closed to isolate higher fluid pressure below from above the valve. Pressure 142 within riser 102, which may be significantly higher than atmospheric pressure is released to equalized pressure in the space within riser 102 with the atmosphere. Conveyance device 140 may then be disconnected from deployment bar 134 and pulled upward in riser 102, as shown in FIG. 2D. Detached from conveyance device 140, portion of tool string 128 is secured in place by pipe or pipe/slip rams 122 and 124.

Figure 3E:
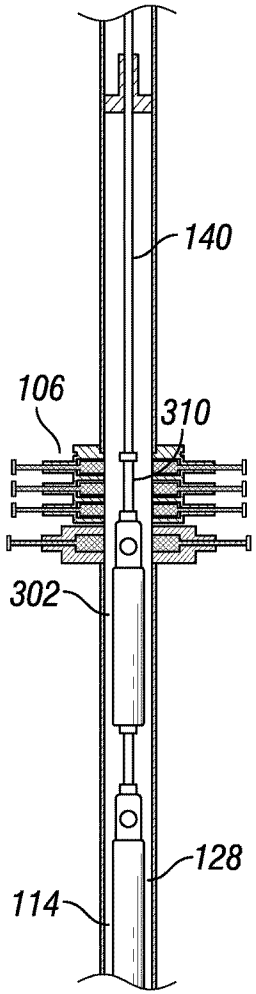
FIG. 3 depicts a coiled tubing apparatus useful with blowout preventers in accordance with an aspect of the disclosure.
Figure 3D:
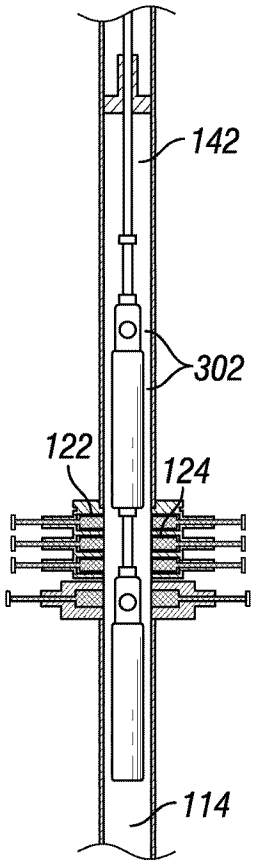
Figure 3C:
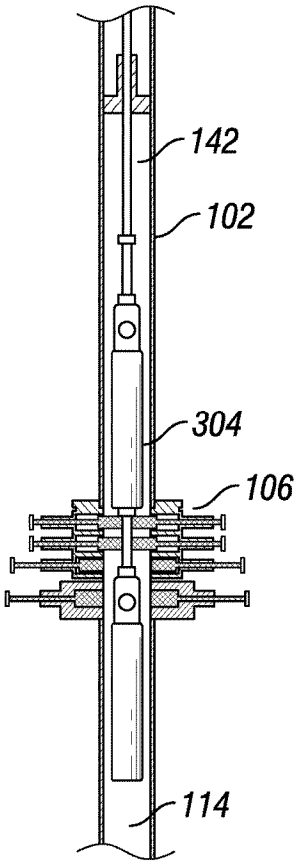
Figure 3B:
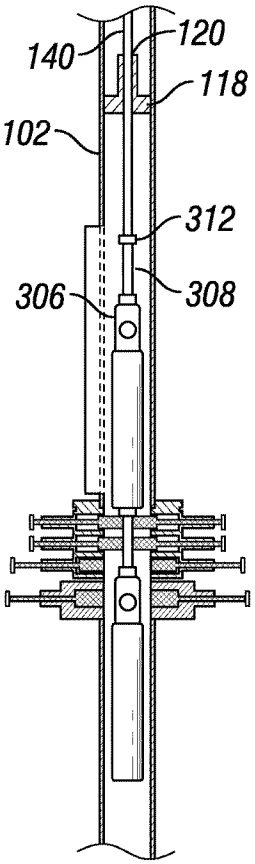
Figure 3A:
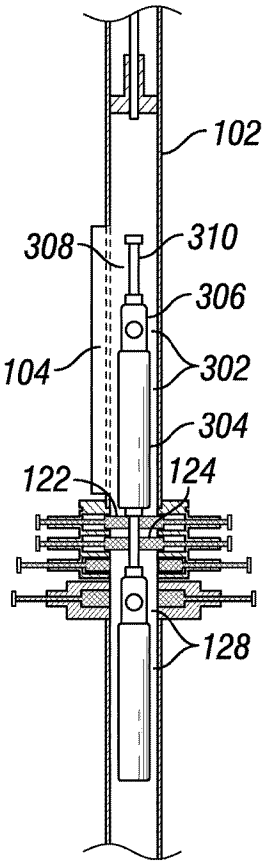

Now referring to FIGS. 3A through 3E, which together depict deployment of another portion of a tool string into a wellbore. With portion of tool string 128 is secured in place by pipe or pipe/slip rams 122 and 124, a second portion of a tool string 302 may be assembled within riser 102 through window opening 104, as shown in FIG. 3A. Second portion of a tool string 302 may include coiled tubing tool 304, deployment valve 306, and deployment bar 308 including deployment neck 310. In FIG. 3B, after assembling the second portion of a tool string 302, conveyance device 140 may be passed through opening 120 of lubricating/sealing device 118 and connected with tool string portion 302 at distal end 312 of deployment bar 308. The valve in deployment valve 306 is in a closed position thus isolating higher fluid pressure from below from above the valve. As depicted in FIG. 3C, window opening of riser 102 is now closed to provide a pressure barrier from the atmosphere as the space within riser 102 is increased to pressure 142 substantially equal to wellbore 114 pressure. Pressure containment within riser 102 is then verified, and lower end of tool 304 is disposed top of blow out preventer 106.

With pressure containment within riser 102 verified, pipe or pipe/slip rams 122 and 124 may then be opened, as shown in FIG. 3D, which may equalize pressure between along wellbore 114 and within riser 102. Valve contained within deployment valve 306 may also be opened. Second portion of a tool string 302 is then moved into wellbore 114 to a target location by conveyance device 140, with deployment neck 310 positioned adjacent and within deployment blow out preventer 106 at a target location, as shown in FIG. 3E. A suitable locating device and/or technique, such as those described above, may be used to detect and/or fix the position of the deployment neck 310 within deployment blow out preventer 106. At this point, if the coiled tubing operation only utilizes the tool string portions 128 and 302 shown, then in the case that conveyance device 140 is the coiled tubing attached, and suitable for performing the operation, tool string portions 128 and 302 may be moved further into wellbore 114 to targeted operation region(s) therein, and operations performed.

However, in some cases it may be desirable to add further tool string portions including a coiled tubing tool, a deployment valve, and deployment bar. In such instances, the steps described above and illustrated in FIGS. 2C through 3E may be repeated as many times necessary in order to deploy the requisite tools into the wellbore. Once the tool string is assembled, and appropriate conveyance device attached, the tool string portions may be moved further into wellbore 114 to targeted operation region(s) therein, and operations performed.

Figures 4A, 4B, 4C, 4D, 4E, 4F:
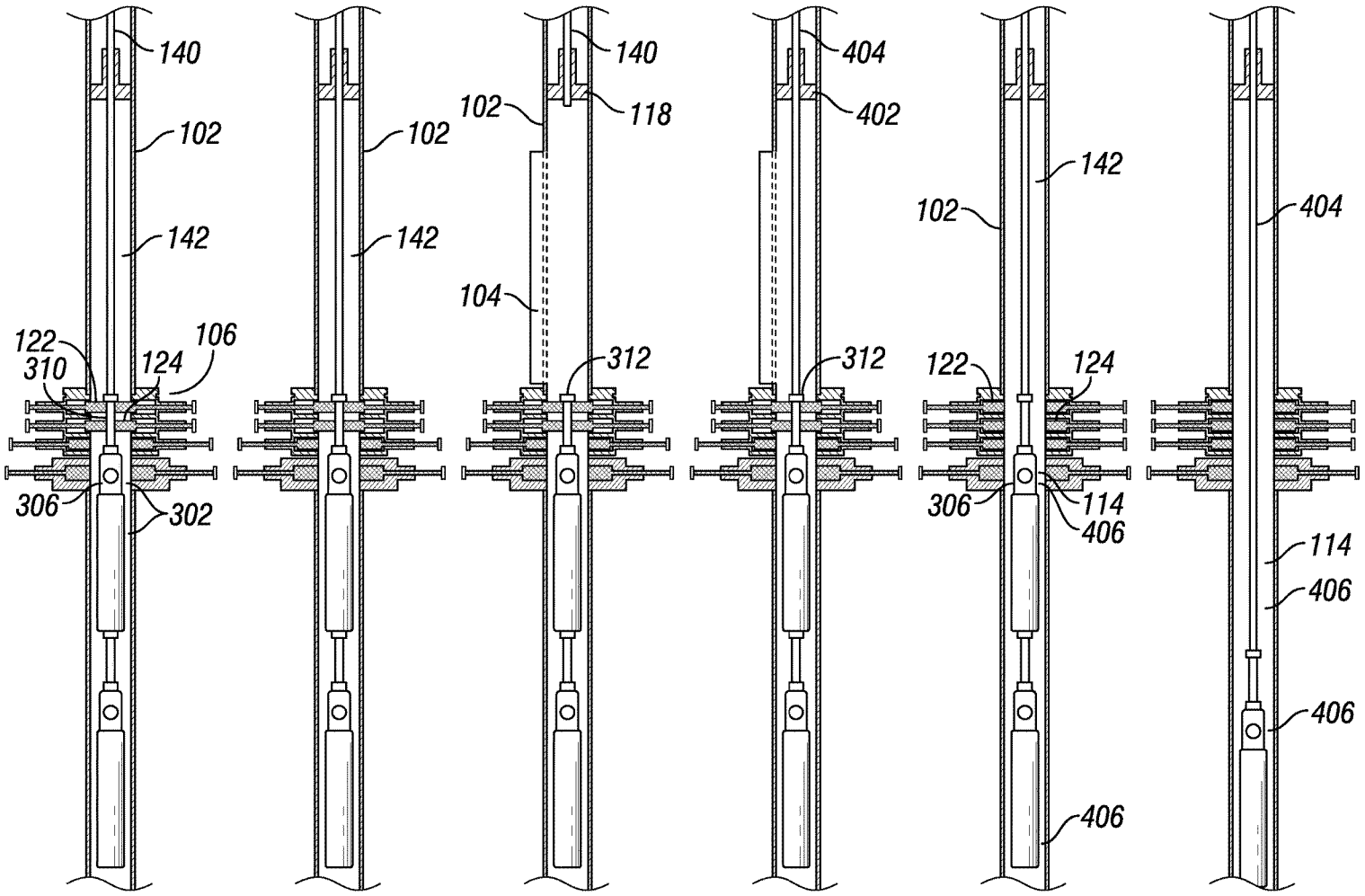
FIGS. 4A-4F illustrate deployment of coiled tubing tools into a wellbore utilizing blowout preventers according to the disclosure.

Now referencing FIGS. 4A through 4F, in some instances the conveyance is switched to a different conveyance device 140, such as could be the case when the conveyance device 140 is a wireline cable, but for operations, coiled tubing is required for conveyance and performing wellbore operations, by non-limiting example. Many of the steps described above, and shown in FIGS. 2C and 2D, may be repeated at this point. As depicted in FIG. 4A, pipe or pipe/slip rams 122 and 124 in blow out preventer 106 are closed on deployment neck 310 to secure portion of tool string 302 and to isolate pressure 142 in the space within riser 102. The valve contained within deployment valve 306 is also closed, or allowed to close as pressure begins to decrease, to isolate higher fluid pressure below from above the valve. Pressure 142 within riser 102, which may be significantly higher than atmospheric pressure can then be released to equalized pressure in the space within riser 102 with the atmosphere, as shown in FIG. 4B. As depicted in FIG. 4C, window 104 in riser 102 may be opened, conveyance device 140 disconnected from deployment bar end 312 and pulled upward in riser 102, and even removed there from, as well as lubricating/sealing device 118. As necessary, lubricating/sealing device 118 can be switched to a suitable lubricating/sealing device 402 for the next conveyance device 404, the next conveyance device 404 introduced there through, into riser 102, and attached to deployment bar end 312, as illustrated in FIG. 4D. As depicted in FIG. 4E, window opening 104 of riser 102 is closed thus creating a pressure barrier from the atmosphere as the space within riser 102 is increased to pressure 142, which is substantially equal to wellbore 114 pressure. Pressure containment within riser 102 is verified, and pipe or pipe/slip rams 122 and 124 opened, as shown in FIG. 4E, which may equalize pressure between along wellbore 114 and within riser 102. Valve contained within deployment valve 306 may also be opened. The tool string 406, consisting of conveyance device 404, portions 128 and 302 of tool string, is then moved deeper into wellbore 114 to a target location by conveyance device 404, as shown in FIG. 4F. A suitable locating device and/or technique, such as those described above, may be used to detect and/or confirm the position of the tool string 406 in wellbore 114 for performing the operation(s).

After wellbore operation(s) are completed, the activity sequence described above described may be substantially reversed, as appropriate, to remove the tool, or tools, from the wellbore. As any tool is removed, or otherwise disassembled from the tool string, in all but the last removal step, pipe or pipe/slip rams 122 and 124 will be closed on the deployment bar beneath the tool being removed, and valve closed in the deployment valve beneath the tool being removed. The deployment bar and valve remain sealed and closed, respectively, while space in riser 102 is depressurized and window 104 open facilitating the tool removal. After the first removal, window 104 will be closed, space in riser 102 repressurized to wellbore pressure, pipe or pipe/slip rams 122 and 124 opened, and the tool string pulled up to repeat the process for each tool string portion except the last portion. When the last, or distal portion of the tool string is pulled up into the riser, the master valve in the wellhead is closed isolating wellbore pressure from the space riser. This last portion of the tool string may be removed from riser 102 through window 104 when the space in riser 102 is equivalent to atmospheric pressure.

In those steps where a connection is made or broken with one side being connected to a deployment bar secured within the deployment blow out preventer by rams contained therein, the connection or break may be performed in the work window provided for the purpose, as described above. The various deployment tool parts are configured to place the connector within this window for easy access. In some cases, such connectors are capable of being connected without the rotation of the portion of the tool string being held, and in some cases, without rotation of the tool parts in the riser as well.

However, in some other aspects the connection to the deployment conveyance may be provided with a rotating joint that allows the upper member to rotate during connection. In the case of the final connection of the tool string to the coiled tubing in the deployment thereof, this connection may be arranged such that neither the coiled tubing nor last portion of the tool string needs to rotate to complete the connection. Also, in some embodiments, one or more electrical connections may be made in the final connection, and such electrical connection(s) may be made by any suitable connection, including, but not limited to one of the following a rotationally symmetric stinger with contact rings and a mating female part with contacts, one or both sets of pins or sockets are arranged such that they may be rotated enough to allow makeup without rotating the housings, magnetic coupling is used to transfer energy and/or signals across the joint without an electrical connection (such couplings may have multiple magnetic paths and be arranged in concentric circles or as stacked rings), or a single pin be located on the centerline and the housing used as an electrical connection.

As part of the contingency plans, in the case of wellbore pressure leakage or unexpected pressure decrease above the deployment blow out preventer, the necks of the deployment bars useful in embodiments or disclosure are designed such that they are sealingly shearable by shearing ram(s) 126 contained in deployment blow out preventer 106. The same ram(s) may be capable of cutting the deployment means, and in some cases, the deployment blow out preventer 106 may have a means to seal on the deployment means. Some suitable nonlimiting examples of such deployment bars, and shearing ram(s) contained in deployment blow out preventer, are disclosed in U.S. Provisional Pat. App. Ser. No. 62/115,750 and related continuity patent applications, and U.S. Provisional Pat. App. Ser. No. 62/115,731 and related continuity patent applications, respectively, the disclosures of which are incorporated herein by reference in their entirety.

In some aspects in accordance with the disclosure, the deployment conveyance device has a range of motion which no more than one order of magnitude, or otherwise about 10 times longer than that required for the longest deployment tool string portion (such as 128 and 302 above) length. The deployment length may be comparable to the full boom extension of a standard coiled tubing crane, rather than that of a high capacity-long lift crane. Also, in some aspects, the deployment operation is carried out with a standard coiled tubing crane, rather than the high-lift high capacity crane that would be required for deploying the entire tool at once in a single riser.

Figure 5:
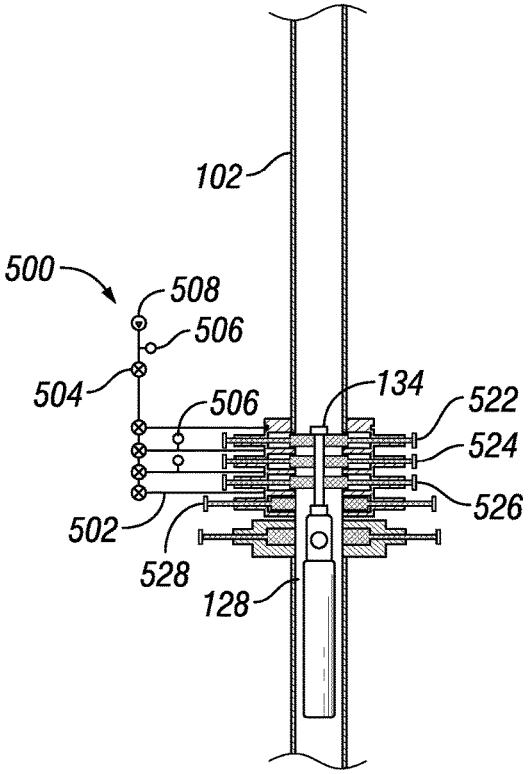
FIG. 5 shows a testing system used in accordance with an aspect of the disclosure; and, FIG. 6 illustrates a distal end of a coiled tubing which includes a valve and plurality of test ports used according to the disclosure.

Some embodiments of the disclosure further include testing system used in methods, which is in fluid communication with the wellbore and interior of the riser, such as that depicted in FIG. 5. As shown, testing system 500 includes components such as pressure lines 502 (five shown), valves 504 (five shown), pressure transducers 506 (three shown), and pressure gauge 508. Pressure lines 502 may be ported through the manifold of the blow out preventer 106 between pipe/slip rams 522, 524 and 526, which are depicted as sealing on deployment neck 134 and forming ram pressure cavities between the various pipe/slip rams 522, 524, and 526 when sealed on the deployment neck 134. Testing system 500 may be used to test the pressures at the many points in the wellbore and interior of the riser to confirm sealing of the rams prior to opening the riser 102, or during any practical point in a deployment operation. Upon completion of a successful test(s), the deployment and/or wellbore operation may continue.

Figure 6:
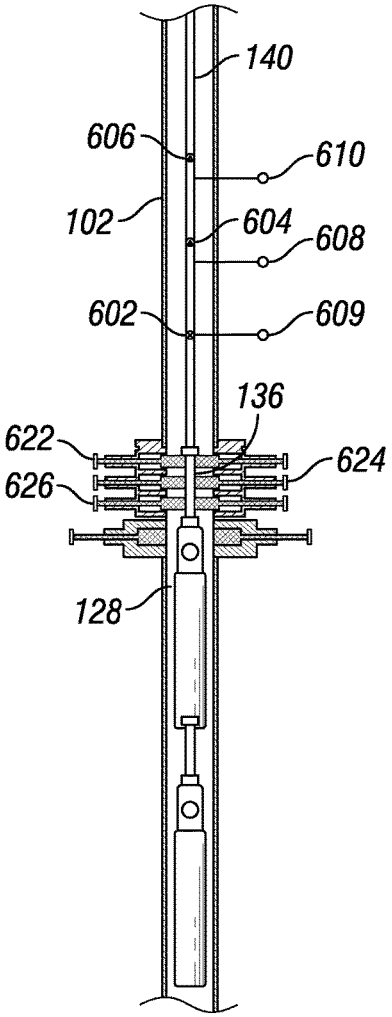

In some other aspects of the disclosure, the distal end of coiled tubing attached to the tool string may include a valve and plurality of test ports disposed adjacent the end, for opening and closing fluid flow through the tool, as well as testing fluid pressure within the coiled tubing itself. FIG. 6 illustrates one such embodiment useful in methods according to the disclosure. Coiled tubing 140 is attached to deployment bar 136, which is secured and sealed in place within wellbore 128 by rams 622, 624 and 626. Distal end of coiled tubing 140 includes valve 602 disposed within coiled tubing 140 and proximate deployment bar 136. Upstream from valve 602 are check valves 604 and 606 within coiled tubing 140. Coiled tubing 140 further includes test ports 608 and 610 for measuring the pressure in the coiled tubing. The valve 602, when closed, forms a seal above and below the valve 602 and a test port or ports 609 may be provided for measuring pressure and testing the seals and/or sealing of the valve 602, as well as for measuring pressure and testing for sealing between the valve 602 and the check valves 604 and 606. In operation, when the riser 102 is to be, or is equalized in pressure with the atmosphere, valve 602 should be closed, and pressure confirmed with test ports 608 and 610.

Figure 7A:
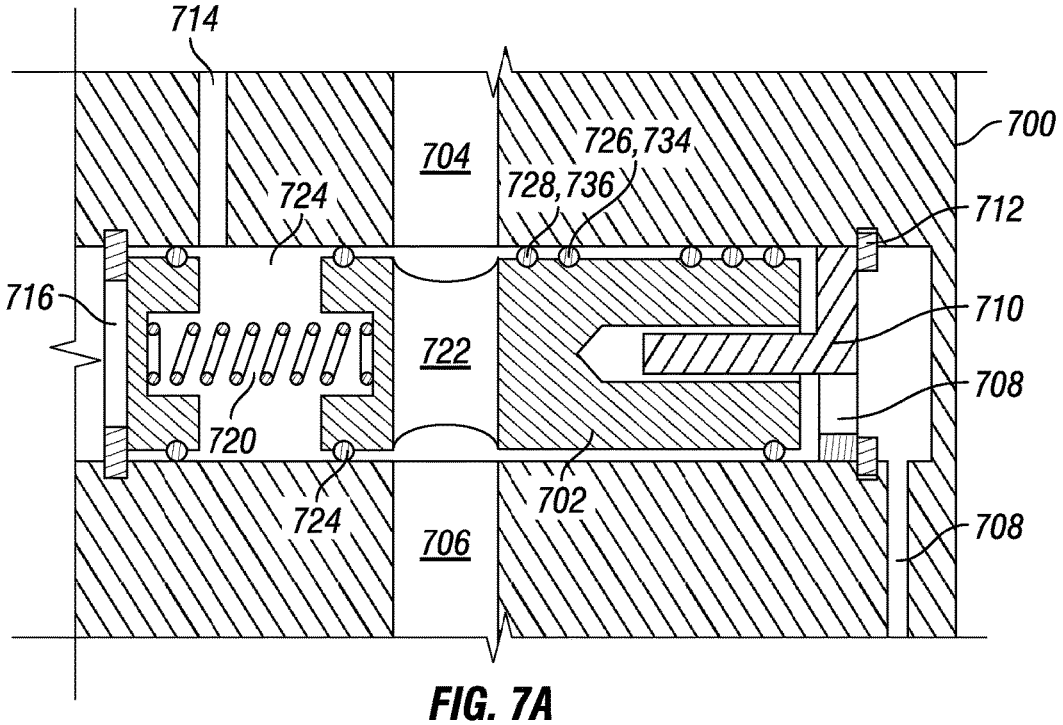
FIGS. 7A-7C depict an embodiment of a valve in cross-sectional and perspective views, in accordance with an aspect of the disclosure
Figure 7B:
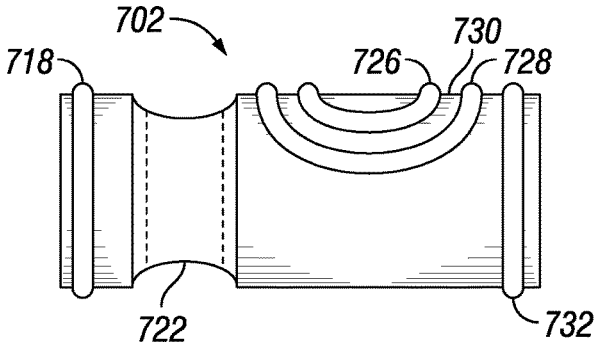
Figure 7C:
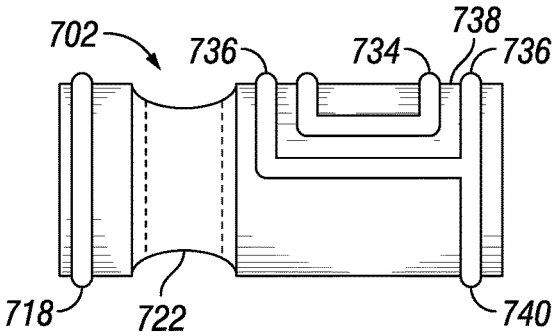

The valve 602 may comprise, in a non-limiting, embodiment according to the disclosure, as shown in FIGS. 7A through 7C, a spool valve 702 is disposed in a cylinder defined within body 700, such as a part of the coiled tubing 140. Referring to FIG. 7A, a cross-sectional view of the embodiment, upper passage 704 extends within body 700, and upper passage 704 requires the capability to be isolated from lower passage 706 (extending within body 400) during deployment. Body 700 and valve 602 may be positioned within a coiled tubing, as depicted in FIG. 6, hereinabove. A passageway 708 providing fluid communication with the wellbore below body 700 and spool valve 702 is provided through body 700 and anti-rotation pin 710, which is held in place by snap ring 712. Passage 714 extends within body 700 and provides pressure communication to a point above the valve and end of spool valve 702 closed by cap 716. The pressure in passage 714 is isolated from fluid flow passages 704 and 706 by seal 718. In a normal position, with pressures above and below body 700 and/or the valve 602 like or very similar, spring 720 biases spool valve 702 in an open position, which allows fluid communication between fluid flow passages 704 and 706 through fluid passageway 722 extending through spool valve 702. When the pressure below body 700 and/or the valve 602 is higher than that above, spool valve 702 moves to a closed position by fluid pressure from the wellbore below through passageway 708. Spring 720 is compressed, and fluid flow communication between fluid flow passages 704 and 706 is cut off, or otherwise isolated, as fluid passageway 722 in spool valve 702 is completely contained within opening 724.

Spool valve 702 is shown in an un-sectioned perspective view in FIG. 7B. In this embodiment, through passage 722, and O-rings or bonded seals 726 and 728 are provided around sealing area or pressure testing cavity 730 which provide sealing to further isolate upper passage 704 from lower passage 706 when spool valve 702 is in a closed position. Seal 728 provides redundant sealing, and seal 732 isolates passageway 708 (having pressure communication with the wellbore below body 700) from fluid flow passages 704, 706 and 722. Pressure testing cavity 730 is in fluid communication with port 609 for testing the seals 726 and 728, whereby fluid may be introduced under pressure to the cavity 730 and the pressure measured in the cavity 730. If there is no leakage of pressure (or leakage within an acceptable limit) from the cavity 730, the pressure test of the valve 602, 702 is successful. In another spool valve embodiment, depicted in FIG. 7C, non-rounded seals 734 and 736 provide sealing functions around sealing area 738. The end seal is shown as provided by seal 736, which further includes a seal extension 740, although in some embodiments, these may be separated. Sealing on the up-hole side as shown by seal set 726 and 728, or 734 and 736, may provide advantage as pressure from below in passage 706 may move spool valve 702 against the port formed in tool body 400 which accommodates spool valve 702, thus reducing the extrusion of seals 726 and 728, or 734 and 736, in any gap in the port. Further, such arrangement of seals minimizes the length of the seals that must move across and through the port, as the seal remains in sealingly contact with the seal bore when spool valve 702 is moved from an open to closed position, and vice versa.

In some method embodiments, the space in the wellbore 128 between an inverted pipe ram and a bottom pipe or pipe/slip ram is connected to the space between a bottom valve within a coiled tubing tool and a middle valve in the tool, and these are pressure tested together. Further, the space between two upper pipe or pipe/slip rams may be connected to the space between the middle valve and an upper tool valve, which allows these to be tested together. Such methods allow the rams and the tool valves to be part of the same well barrier envelope, which are tested at the same time.

The embodiments described above depict coiled tubing operations which are useful with a land based rig, and the embodiments according to the disclosure may also be used for coiled tubing deployment on an offshore platform or installation, including floating platforms, fixed leg, tension leg, and the like.

The foregoing description of the embodiments has been provided for purposes of illustration and description. Example embodiments are provided so that this disclosure will be sufficiently thorough, and will convey the scope to those who are skilled in the art. Numerous specific details are set forth such as examples of specific components, devices, and methods, to provide a thorough understanding of embodiments of the disclosure, but are not intended to be exhaustive or to limit the disclosure. It will be appreciated that it is within the scope of the disclosure that individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Also, in some example embodiments, well-known processes, well-known device structures, and well-known technologies are not described in detail. Further, it will be readily apparent to those of skill in the art that in the design, manufacture, and operation of apparatus to achieve that described in the disclosure, variations in apparatus design, construction, condition, erosion of components, gaps between components may present, for example.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly. In the figures illustrated, the orientation of particular components is not limiting, and are presented and configured for an understanding of some embodiments of the disclosure.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method comprising:

providing a first portion of a tool string comprising a tool, a deployment bar, and at least one valve comprises a valve therein which is selectively operable under wellbore pressure and further comprises a fluid passageway therethrough, the valve further comprising at least one test port for pressure testing at least two seals of the valve and the pressure testing cavity between the seals of the valve;

connecting the first portion of a tool string to a conveyance device in a riser;

moving the first portion of a tool string into a blowout preventer body comprising at least one sealing ram for engaging with a neck on the deployment bar, wherein the valve is in an open position and the riser is under wellbore pressure during the moving;

closing at least two sealing rams on the neck and forming at least one ram pressure cavity to be tested;

closing the valve;

pressure testing the formed ram pressure cavity in the direction of wellbore pressure; and, reducing pressure in the riser after successfully pressure testing the ram pressure cavity.

2. The method of claim 1 further comprising:

disconnecting the conveyance device from the first portion of a tool string;

providing a second portion of a tool string comprising a second tool, a second deployment bar, and a second deployment valve, wherein the second deployment valve comprises a valve therein which is operable under wellbore pressure and further comprises a fluid passageway therethrough;

connecting the second portion of a tool string to the conveyance device and to the first portion of a tool string in the riser;

pressurizing the riser releasing the at least one sealing ram from the neck of the first deployment bar; and, moving the second portion of a tool string into the blowout preventer body and moving the first portion of a tool string into a wellbore, wherein the each of the valves in the first and second portions is in an open position and wherein the valves are in fluid communication, and wherein the riser is under wellbore pressure during the moving.

3. The method of claim 2 further comprising deploying the first and second portions of a tool string into the wellbore and conducting at least one wellbore operation.

4. The method of claim 2 wherein the tool and the second tool are coiled tubing tools.

5. The method of claim 2 further comprising:

closing the at least one sealing ram on a neck of the second deployment bar;

reducing pressure in the riser and allowing the valves in the first and second portions to close;

disconnecting the second portion of a tool string from the conveyance device;

connecting the second portion of a tool string to a coiled tubing in the riser;

releasing the at least one sealing ram from the neck of the second deployment bar; and, deploying the first and second portions of a tool string into the wellbore and conducting at least one wellbore operation.

6. The method of claim 2 wherein the connecting the second portion of a tool string to the conveyance device and to the first portion of a tool string is conducted through a window in the riser.

7. The method of claim 1 where the valve is pressure tested from a wellbore side before reducing pressure in the riser.

8. The method of claim 1 wherein the conveyance device is a coiled tubing which includes at least one check valve and one or more additional valves which maintain pressure in two directions.

9. The method of claim 8 wherein the at least one check valve provides an initial sealing means to allow reducing pressure in the riser.

10. The method of claim 1 wherein the conveyance device is coiled tubing.

11. The method of claim 1 wherein the blowout preventer body is fluidly connected with a hydraulic control valve for sensing a differential pressure across the at least one sealing ram, and wherein the hydraulic control valve operates as a hydraulic interlock to prevent the at least one sealing ram from being moved to a ram open position under predetermined differential pressure conditions.

12. The method of claim 1 wherein the at least one sealing ram is contained within a cylinder formed in the blowout preventer body, and wherein each of the at least one sealing rams is connected with a ram piston sealingly disposed in the cylinder.

13. The method of claim 1 wherein the neck extends between end connections, wherein the end connections are configured to be attached to a coiled tubing tool string; and, wherein the deployment bar comprises a main flow passage and at least one secondary flow passage extending through the neck and the end connections.

14. The method of claim 1 wherein the fluid passageway in the deployment valve comprises a first fluid passageway and a second fluid passageway, and wherein the first fluid passageway and the second fluid passageway are in fluid communication with a coiled tubing when the valve is in the open position.

15. The method of claim 14 wherein the fluid communication between the first fluid passageway and the second fluid passageway is interrupted when the valve is in a closed position.

16. The method of claim 1 wherein the valve is movable from an open position to a closed position by a pressure differential present across the blow out preventer body.

17. A method of deploying a coiled tubing tool string into a wellbore, comprising:

connecting a first portion of a tool string to a conveyance device in a riser, wherein the first portion of a tool string comprises a deployment valve operable under wellbore pressure;

moving the first portion of a tool string into a blowout preventer body comprising at least one sealing ram for engaging with the first portion of a tool string, wherein the deployment valve is in an open position and the riser is under wellbore pressure during the moving;

closing the at least one sealing ram on the first portion of a tool string, reducing pressure in the riser, and allowing the deployment valve to close;

disconnecting the conveyance device from the first portion of a tool string;

connecting a second portion of a tool string to the conveyance device in the riser, wherein the second portion of a tool string comprises a deployment valve operable under wellbore;

releasing the at least one sealing ram from the first portion of a tool string;

moving the second portion of a tool string into the blowout preventer body and moving the first portion of a tool string into the wellbore, wherein the deployment valves in the first and second portions are in an open position and wherein the valves are in fluid communication, and wherein the riser is under wellbore pressure during the moving.

18. The method of claim 17 further comprising deploying the first and second portions of a tool string into the wellbore and conducting at least one wellbore operation.

19. The method of claim 17 wherein the conveyance device is coiled tubing.

20. The method of claim 17 further comprising:

closing the at least one sealing ram on the second portion of a tool string;

reducing pressure in the riser and allowing the deployment valves in the first and second portions to close;

disconnecting the second portion of a tool string from the conveyance device;

connecting the second portion of a tool string to a coiled tubing in the riser;

releasing the at least one sealing ram from the second portion of a tool string; and, deploying the first and second portions of a tool string into the wellbore and conducting at least one wellbore operation.

21. A method of deploying a coiled tubing tool string into a wellbore, comprising:

providing a system comprising of a wellhead disposed on a wellbore casing, a blowout preventer body disposed on the wellhead, and a riser disposed on the blowout preventer body, wherein the blowout preventer body comprises at least one sealing ram for engaging with the first portion of a tool string;

connecting a first portion of a tool string to a conveyance device in the riser, wherein the first portion of a tool string comprises a deployment valve operable under wellbore pressure;

moving the first portion of a tool string into the blowout preventer body, wherein the deployment valve is in an open position and the riser is under wellbore pressure during the moving;

closing the at least one sealing ram on the first portion of a tool string, and reducing pressure in the riser;

disconnecting the conveyance device from the first portion of a tool string;

connecting a second portion of a tool string to the conveyance device in the riser, wherein the second portion of a tool string comprises a deployment valve operable under wellbore;

releasing the at least one sealing ram from the first portion of a tool string; and, moving the second portion of a tool string into the blowout preventer body and moving the first portion of a tool string into the wellbore, wherein the riser is under wellbore pressure during the moving.

22. The method of claim 21 further comprising deploying the first and second portions of a tool string into the wellbore and conducting at least one wellbore operation, and wherein the conveyance device is coiled tubing.

23. The method of claim 21 further comprising:

closing the at least one sealing ram on the second portion of a tool string, and reducing pressure in the riser;

disconnecting the second portion of a tool string from the conveyance device;

connecting the second portion of a tool string to a coiled tubing in the riser;

releasing the at least one sealing ram from the second portion of a tool string; and, deploying the first and second portions of a tool string into the wellbore and conducting at least one wellbore operation.

24. A method comprising:

providing a first portion of a tool string comprising a tool, a deployment bar, and at least two deployment valves, wherein the deployment valve comprises a valve therein which is operable under wellbore pressure, a fluid passageway therethrough, and at least two seals;

connecting the first portion of a tool string to a conveyance device in a riser;

moving the first portion of a tool string into a blowout preventer body comprising at least one sealing ram for engaging with a neck on the deployment bar, wherein the valve is in an open position and the riser is under wellbore pressure during the moving;

closing the at least one sealing ram on the neck, closing one or more of the valves; and, reducing pressure in the riser.

25. The method of claim 24 further comprising:

disconnecting the conveyance device from the first portion of a tool string;

providing a second portion of a tool string comprising a second tool, a second deployment bar, and a second deployment valve, wherein the second deployment valve comprises a valve therein which is operable under wellbore pressure and further comprises a fluid passageway therethrough;

connecting the second portion of a tool string to the conveyance device and to the first portion of a tool string in the riser;

increasing pressure in the riser to wellbore pressure releasing the at least one sealing ram from the neck of the first deployment bar; and, moving the second portion of a tool string into the blowout preventer body and moving the first portion of a tool string into a wellbore, wherein the valves in the first and second portions are in an open position and wherein the valves are in fluid communication, and wherein the riser is under wellbore pressure during the moving.

26. The method of claim 24 further comprising testing the at least two seals before opening the riser.

27. The method of claim 24 further comprising testing the at least two seals after opening the riser.

* * * * *